United States Patent [19]

Schmidt

[11] Patent Number: 4,923,336

[45] Date of Patent: May 8, 1990

[54] DOCK SUPPORTING APPARATUS

[75] Inventor: David A. Schmidt, Bay City, Mich.

[73] Assignee: Schmidt Industries, Inc., Bay City, Mich.

[21] Appl. No.: 221,206

[22] Filed: Jul. 19, 1988

[51] Int. Cl.[5] ..... E02B 15/02

[52] U.S. Cl. ..... 405/216; 405/61; 405/217; 405/219; 405/221

[58] Field of Search ..... 405/211, 216, 217, 218, 405/219, 221, 61

[56] References Cited

U.S. PATENT DOCUMENTS

| | | | |
|---|---|---|---|
| 291,208 | 1/1884 | Leslie | 405/216 X |
| 3,170,299 | 2/1965 | Clarke | 405/61 |
| 3,180,099 | 4/1965 | Mikolajczyk | 405/216 |
| 3,370,432 | 2/1968 | Butler | 405/216 |
| 3,495,565 | 2/1970 | Gustavii | 405/211 X |
| 3,543,523 | 2/1969 | Nelson | 405/217 X |
| 3,555,827 | 1/1971 | Herr | 405/61 |
| 4,126,006 | 11/1978 | Lewis | 405/221 X |
| 4,464,083 | 8/1984 | Wathey | 405/216 |

FOREIGN PATENT DOCUMENTS

| | | | |
|---|---|---|---|
| 0598528 | 5/1960 | Canada | 405/221 |
| 0193618 | 11/1982 | Japan | 405/216 |

*Primary Examiner*—Randolph A. Reese
*Assistant Examiner*—Franco DeLijarori
*Attorney, Agent, or Firm*—Learman & McCulloch

[57] ABSTRACT

A dock support having a piling composed of an upstanding rod the lower end of which is adapted to be embedded in the bottom of a body of water and an external telescoping sleeve having a cap at its upper end which normally confronts and seats on the upper end of the rod. A passage exists between the confronting surfaces of the inner and outer telescoping members and such passage is occupied by air, rather than water. The air prevents water in the passage rising to the level at which it may freeze, but should water in the passage rise to the freezing level compressed air may be admitted to the passage via a valve under sufficient pressure to purge such water.

9 Claims, 1 Drawing Sheet

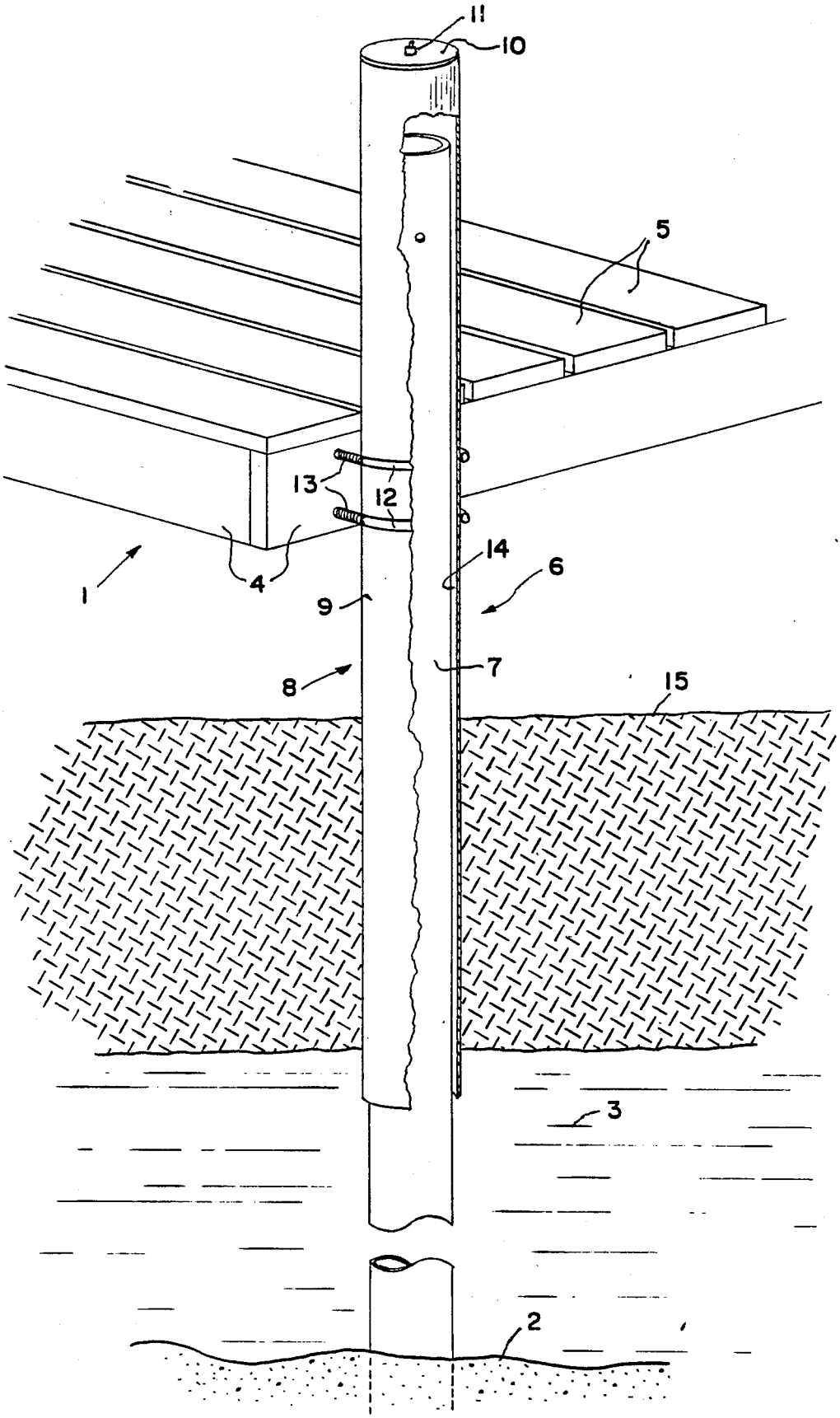
11
10
5
13
12
14
6
1
4
9
7
8
15
3
2

DOCK SUPPORTING APPARATUS

This invention relates to dock supporting pilings adapted to support a dock above the level of the surface of a body of water and which enable the dock to rise and fall with corresponding movements of a layer of ice without withdrawing the pilings from the bottom.

BACKGROUND OF THE INVENTION

It is conventional to support a dock above the surface of a body of water by means of pilings which have their lower ends embedded in the bottom of the body of water and their upper ends secured to the dock. In those geographic regions where ice forms on the surface of the water the ice adheres to the pilings with the result that, as the ice rises and falls, the pilings are moved vertically relative to the bottom thereby weakening or destroying the support for the dock. It is not uncommon, therefore, for dock owners to remove their docks from the water prior to the water's freezing and return the docks to the water when the likelihood of further freezing no longer is present. The removal and replacement of such docks is a laborious, time consuming, and often expensive undertaking.

The undesirable effects of icebound dock movements have been recognized heretofore and numerous proposals have been advanced in an effort to overcome or minimize such problems. Not all of the proposed solutions have been satisfactory for a variety of reasons.

An object of the present invention is to provide dock supporting apparatus which is capable of overcoming the effects of vertical movements due to the presence of ice on the surface of a body of water.

SUMMARY OF THE INVENTION

Dock supporting apparatus according to the invention comprises a plurality of pilings each of which is composed of two relatively telescoped members the inner one of which has its lower end embedded in the bottom of a body of water and the outer one of which is secured to the dock. The inner telescoping member extends to a desired level above the surface of the water and the outer telescoping member is of such length as to have its lower end extend below the water's surface to a level below that of the ice. The upper end of the outer telescoping member is sealed by a cap so that no water can enter such member except via its lower end.

The cap of the outer telescoping member has an opening therein for the passage of air, and such opening is closed by a valve which permits compressed air to enter the outer member, but prevents the escape of air through the opening.

When the dock is in condition for use, compressed air is passed into the outer telescoping member so as to expel all, or substantially all, of the water therefrom. Thus, for substantially the full length of the outer telescoping member there is nothing between it and the inner member but air which is incapable of freezing. Consequently, should ice form on the surface of the body of water and adhere to the outer telescoping member, vertical movements of the ice may be imparted to the outer member, but since the outer member is freely movable longitudinally of the inner member, vertical movements of the outer member are not imparted to the inner member. The inner member, therefore, is not subjected to forces tending to withdraw it from the bottom of the body of water.

THE DRAWING

The single drawing FIGURE is a fragmentary, isometric view, partly in section, of a dock and dock support constructed and installed in accordance with the preferred embodiment of the invention.

DETAILED DESCRIPTION

Apparatus constructed in accordance with the invention is adapted for use in supporting a dock 1 above the bottom 2 of a body of water 3, such as a lake, river, or stream. The dock comprises frame members 4 rigidly secured to one another and on which is secured deck planking 5. The dock is supported by a plurality of identical pilings 6, one of which is disclosed in the drawing.

Each piling includes an elongate rod or member 7 which may be either solid or tubular and the lower end of which is adapted to be embedded to an appropriate depth in the bottom 2. In external telescoping relation with the rod 7 is a tubular cylinder or member 8 having a wall 9 open at its lower end and closed at its upper end by an end cap 10. Preferably, the members 7 and 8 are of circular cross section but could have other cross sectional configurations if desired.

An opening or inlet is provided in the cap 10 and in such opening is fitted a conventional, one-way valve 11 which enables gas, such as compressed air, to pass into the interior of the member 8. The valve may correspond to that used in connection with automotive tires, or it may be any other suitable one-way valve which prevents the flow of gas outwardly of the member 8.

At suitable intervals are located clamp means for securing the dock 1 to the piling 6. In the disclosed embodiment, the clamp means comprises a pair of U-bolts 12 having threaded ends 13 which extend through openings in a frame member 4 and on which are secured threaded nuts (not shown).

To condition the apparatus for operation, the member 7 is embedded in the bottom 2 of the body of water so as extend upwardly in an erect manner above the surface of the water. The tubular member then is telescoped over the upper end of the member 7 and lowered until the inner surface of the cap 10 rests upon the upper end of the member 7. The securing bolts 12 then may be used to clamp the tubular member 8 to the frame 4 of the dock 1, whereupon the latter will be supported at a desired level above the surface of the water.

In the preferred embodiment, the outside diameter of the member 7 is one-half inch to one inch smaller than the bore or inside diameter of the member 8. This ensures sufficient clearance between the confronting surfaces of the members 7 and 8 to enable the latter to slide freely longitudinally of the member 7. It also ensures the provision of a passage 14 between the confronting surfaces of such members through which air may flow.

When freezing temperatures are anticipated, a gas, such as compressed air, may be introduced to the interior of the member 8 via the valve 11, thereby purging water from virtually the entire length of the passage 14. The length of the member 8 should be so selected that its lower end will extend to a level well below that at which ice forms. A distance of 18–30 inches below the surface of the water normally will be adequate. Thus, when a layer 15 of ice does form on the surface of the body of water 3, the ice may adhere to the outer surface of the wall 9 of the member 8, but will not adhere to the member 7. Since those portions of the passage 14 at and above the level of the ice contain air, rather than water, there is nothing between the members 7 and 8 which can freeze. Accordingly, any vertical movements imparted by the ice layer 14 to the member 8 will not be transmitted to the member 7 and the lower end of the latter will not be withdrawn from the bottom 2.

Obviously, the wall thickness of the members 7 and 8 should be sufficient to withstand the crushing force exerted by the ice, and the thickness of the wall of the member 8 should be sufficient to withstand the clamping force exerted by the securing means 12. Steel tubing having a wall thickness of $\frac{3}{8}$ inch has been found to be satisfactory.

In the preferred embodiment the inner member 7 is of such length as to extend 2–3 feet above the surface of the water. This, coupled with the extension of the outer member 8 to a level well below the thickness of the ice, enables air trapped below the end cap 10 normally to prevent water from rising in the passage 14 to the level at which ice forms. Should the assembly of the members 7 and 8 be sufficiently careless to have a high level of water in the passage, or should the water level rise because of contraction of the volume of air within the tubular member or because of absorption of air by the water, the passage 14 initially and periodically may be purged by introducing air under pressure to the interior of the member 8 via the valve 11.

For purposes of clarity of illustration the end cap 10 is shown in the drawing as being spaced from the upper end of the member 7. It will be understood, however, that in non-freezing temperatures the cap will seat on the upper end of the member 7.

It also will be understood that the valve 11 and the opening in which it is secured need not necessarily be in the cap 10. The opening and valve could be in the wall 9, and preferably above the level of the surface of the water. However, it is convenient to place the valve in the cap.

The disclosed embodiment is representative of a presently perferred form of the invention, but is intended to be illustrative rather than definitive thereof. The invention is defined in the claims.

I claim:

1. Apparatus for supporting a dock or the like above the bottom of a body of water, said apparatus comprising an elongate piling member having one end thereof embedded in said bottom and its other end extending above the surface of said water; an elongate, tubular member in external telescoping relation with said piling member and extending from said other end of said piling member downwardly toward but terminating short of said bottom, said tubular member having a bore of such cross-sectional dimension as to form a gas containing annular passage between said bore and said piling member; and an end cap carried by said tubular member at its upper end for sealing said bore at its upper end, said end cap normally seating upon said other end of said piling member, said tubular member extending below the surface of said water a distance greater than the thickness of ice which may form on said surface.

2. Apparatus according to claim 1 wherein said members are circular in cross section.

3. Apparatus according to claim 1 wherein said tubular member has an inlet therein through which gas may pass into said passage, and valve means occupying said inlet for preventing the passage of gas outwardly of said passage through said inlet.

4. Apparatus according to claim 3 wherein said inlet is in said cap.

5. Apparatus according to claim 1 including means for securing said tubular member to said dock or the like.

6. Apparatus for supporting a dock or the like above the surface of a body of water having a bottom, said apparatus comprising an elongate piling member having its lower end embedded in said bottom and its upper end extending above said surface; an elongate, tubular member in external telescoping relation with said piling member and extending from above said surface downwardly toward but terminating short of said bottom, said tubular member having a bore of such cross-sectional dimension as to form an annular passage between said bore and said piling member and enable free telescoping movement of said members; and a cap carried by said tubular member for sealing said bore at its upper end and forming a seat for engagement with the upper end of said piling member, said tubular member being of such length that air trapped in said passage prevents water from rising in said passage to a level at which water in said passage may freeze.

7. Apparatus according to claim 6 including an air inlet in said tubular member in communication with said passage, and valve means in said inlet for enabling air to pass therethrough only in a direction into said passage.

8. Apparatus according to claim 7 wherein said inlet is located at a level above that of said surface.

9. Apparatus according to claim 8 wherein said inlet is located in said cap.

* * * * *